US006103431A

United States Patent [19]

Tamaoki et al.

[11] Patent Number: 6,103,431

[45] Date of Patent: Aug. 15, 2000

[54] REWRITABLE, COLOR IMAGE RECORDING MEDIUM AND IMAGE RECORDING METHOD USING SAME

[75] Inventors: Nobuyuki Tamaoki; Hiroo Matsuda; Soyoung Song, all of Tsukuba, Japan

[73] Assignee: Director-General of Agency of Industrial Science and Technology, Japan

[21] Appl. No.: 09/273,491

[22] Filed: Mar. 22, 1999

[30] Foreign Application Priority Data

Sep. 7, 1998 [JP] Japan ..... 10-252533

[51] Int. Cl.[7] ..... G03C 1/00; G03C 1/73

[52] U.S. Cl. ..... 430/20; 430/19; 430/962

[58] Field of Search ..... 430/20, 962, 19; 349/24

[56] References Cited

U.S. PATENT DOCUMENTS 3,627,699 12/1971 Goldberg et al. ..... 250/494.1

3,655,971 4/1972 Haas et al. ..... 430/19

FOREIGN PATENT DOCUMENTS 62-209186 9/1987 Japan .

*Primary Examiner*—John A. McPherson

*Attorney, Agent, or Firm*—Lorusso & Loud

[57] ABSTRACT

A rewritable, color image recording medium composed of a pair of opposed substrates at least one of which is transparent, and an intermediate layer interposed between the substrates. The intermediate layer contains at least one cholesteric liquid crystal compound having a molecular weight of not greater than 2,000 and a glass transition point of at least 35° C., and a photochromic compound. By irradiating the intermediate layer imagewise with the light through the transparent substrate, while maintaining the intermediate layer at such a temperature that the cholesteric liquid crystal compound assumes a cholesteric liquid crystal phase, an image is formed. The image may be fixed by rapidly cooling the recording medium to a temperature lower than the glass transition.

7 Claims, No Drawings

REWRITABLE, COLOR IMAGE RECORDING MEDIUM AND IMAGE RECORDING METHOD USING SAME

BACKGROUND OF THE INVENTION

This invention relates to a rewritable, color image recording medium and to a method of recording an image using the recording medium.

There is a known rewritable, thermosensitive recording medium having a thermosensitive layer containing a derivative of a long chain alkyl carboxylic acid, such as a behenic acid. The thermosensitive layer can assume a white color state and a transparent state depending upon thermal hysteresis thereof.

A color image forming method is also known in which a recording medium, having a intermediate layer containing a cholesteric liquid crystal compound having a molecular weight of not greater than 2,000 and a glass transition point of at least 35° C., is heated imagewise to change the crystal state of the cholesteric liquid crystal compound and to form an image (Tamaoki et al, Advanced Materials, 9(14), 1102 (1977)).

SUMMARY OF THE INVENTION

It is, therefore, an object of the present invention to provide a rewritable, recording medium adapted for giving a color image.

Another object of the present invention is to provide a method of forming a color image using the above recording medium.

In accomplishing the foregoing objects, there is provided in accordance with one aspect of the present invention a rewritable, color image recording medium comprising a pair of opposed substrates at least one of which is transparent, and an intermediate layer interposed between said substrates, said intermediate layer comprising at least one cholesteric liquid crystal compound having a molecular weight of not greater than 2,000 and a glass transition point of at least 35° C., and a photochromic compound, said photochromic compound being present in an amount of 0.5–10% by weight based on the weight of said cholesteric liquid crystal compound.

In another aspect, the present invention provides a method of recording a color image, comprising the steps of:

(a) providing a rewritable, color image recording medium comprising a pair of opposed substrates at least one of which is transparent, and an intermediate layer interposed between said substrates, said intermediate layer comprising at least one cholesteric liquid crystal compound having a molecular weight of not greater than 2,000 and a glass transition point of at least 35° C., and a photochromic compound capable of changing a color thereof upon irradiation with a light, said photochromic compound being present in an amount of 0.5–10% by weight based on the weight of said cholesteric liquid crystal compound;

(b) while maintaining said intermediate layer at such a temperature that said cholesteric liquid crystal compound assumes a cholesteric liquid crystal phase, irradiating said intermediate layer imagewise with the light through the transparent substrate to form an image;

(c) then rapidly cooling said recording medium obtained in step (b) to a temperature lower than said glass transition point to fix said image.

Other objects, features and advantages of the present invention will become apparent from the detailed description of the preferred embodiments of the invention to follow.

DESCRIPTION OF THE PREFERRED EMBODIMENTS OF THE INVENTION

The recording medium according to the present invention has a pair of opposed substrates each generally in the form a sheet, a film or a plate, and an intermediate layer interposed between the substrates. Each of the substrates may be flat or curved and may be rigid or flexible. It is important that at least one of the substrate should be transparent so that the intermediate layer can see through the transparent substrate. The transparent substrate may be formed of, for example, a plastic material or a glass. The opaque substrate may be made of, for example, a paper, a metal or a plastic material. If desired, a light or heat reflecting layer or a light absorbing layer may be interposed between the intermediate layer and one of the substrates that need not be transparent.

The intermediate layer comprises a cholesteric liquid crystal compound having a molecular weight of not greater than 2,000, preferably 600–1,500, more preferably 700–1,200 and a glass transition point of at least 35° C., preferably at least 40° C. The upper limit of the transition point is preferably 110° C., more preferably 100°C. Two or more cholesteric liquid crystal compounds may be used in combination for the purpose of the present invention. Other liquid crystal compounds may be incorporated into the intermediate layer, if desired.

The cholesteric liquid crystal compound represented by the formula:

$$Z—O—CO—R—CO—O—Y$$

wherein Z and Y are each independently selected from the group consisting of a cholesteryl group, a hydrogen atom and an alkyl group preferably having 2–30 carbon atoms, more preferably 2–18 carbon atoms, with the proviso that at least one of Z and Y stands for a cholesteryl group, and R stands for a divalent organic group having 2–30 carbon atoms, preferably 2–22 carbon atoms, may be suitably used for the purpose of the present invention.

The divalent organic group R may be, for example, an aliphatic, alicyclic or aromatic group. Both saturated and unsaturated aliphatic groups and alicyclic groups may be used. The aromatic group may be a divalent group derived from a monocyclic aromatic compound such as benzene, toluene or xylene or from a polycyclic aromatic compound such as naphthalene, biphenyl or terphenyl.

The divalent hydrocarbyl group R may be, for example, one which is represented by the formula:

$$—(CH_2)_m—C{\equiv}C—C{\equiv}C—(CH_2)_n—$$

wherein m and n are each independently an integer of 1 or more with the proviso that the total of m and n does not exceed 30, preferably 20. The total number of m and n is preferably 4 or more.

Illustrative of cholesteric liquid crystal compounds are dicholesteryl 10,12-docosadiynedioate, dicholesteryl eicosadioate, cholesteryl 10,12-pentacosadiynoate, dicholesteryl dodecadioate and dicholesteryl 12,14-hexacosadiynedioate.

The intermediate layer further contains a photochromic compound in an amount of 0.5–10% by weight, preferably 1–5% by weight, based on the weight of the cholesteric liquid crystal compound or a total of the cholesteric liquid crystal compounds (if two or more cholesteric liquid crystal compounds are used in combination). Any photochromic compound such as disclosed in "Photochromism-techniques of Chemistry Vol. III", edited by Glenn H. Brown, Wiley Interscience, 1971 may be used for the purpose of the present invention. Illustrative of suitable photochromic compounds are azobenzene compounds, indigo compounds, fulgide compounds, spiropyran compounds and diallylethene compounds. Photochromic compounds, such as azobenzene compounds, having a molecular structure which is greatly changed upon irradiation with a light are preferably used for reasons of good image stability.

The intermediate layer may further contain one or more additives such as a pigment, a dye and an oxidation resisting agent. The content of the cholesteric liquid crystal compound in the intermediate layer is preferably at least 50% by weight. The thickness of the sensitive layer is not specifically limited, but is generally in the range of 1–100 pm.

The recording medium may be prepared by, for example, forming a molten layer of a composition containing the above cholesteric liquid crystal compound and the photochromic compound on one of the substrates, followed by placement of the other substrate on the molten layer. Alternatively, a molten composition containing the above cholesteric liquid crystal compound and the photochromic compound may be filled in a thin gap between opposed substrates using capillary action or suction force.

The cholesteric liquid crystal compound is colorless or transparent in a non-cholesteric liquid phase (such as a glass state, a crystal phase or an isotropic phase), but is colored in a cholesteric liquid crystal phase. The color of the cholesteric liquid crystal compound in the cholesteric liquid crystal phase varies depending upon not only the kind thereof but also the temperature at which the compound is maintained. The color thus formed can be fixed by rapidly cooling the recording medium to a temperature lower than the glass transition point of the cholesteric liquid crystal compound. The temperature of a portion of or whole of the intermediate layer may be changed to a desired temperature at which the cholesteric liquid crystal compound assumes the cholesteric liquid crystal phase by any suitable method such as by heating the recording medium with a laser beam, a thermal head, a heated roll or a heated stamp or by cooling the recording medium, which has been heated above the desired temperature, with a cold roll or cooling with a cold stamp.

In the present invention, the above characteristics of the cholesteric liquid crystal compound are combined with the light-sensitive property of the photochromic compound.

Thus, by irradiating imagewise a desired portion or whole area of the intermediate layer with a light through the transparent substrate, while maintaining the desired portion or whole area of the intermediate layer at such a temperature that the cholesteric liquid crystal compound assumes a cholesteric liquid crystal phase, an image can be formed on the recording medium, as a result of, for example, photoisomerization of the photochromic compound contained in the intermediate layer. The thus formed image can be fixed by rapidly cooling the recording medium to a temperature lower than the glass transition point of the cholesteric liquid crystal compound.

As a light source for the irradiation, there may be used a mercury lamp, a xenon lamp, a tungsten lamp or a laser source. The wavelength of the light used for irradiating the intermediate layer is determined depending upon the light absorption characteristics of the photochromic compound contained in the intermediate layer.

The rapid cooling for the fixation of the image may be performed by any suitable method such as by immersing the medium in a cold liquid or a cold gas environment or by contacting the medium with a cold gas blow or a cold solid surface. The image fixation by the cooling of the recording medium is preferably carried out at a rate of at least 1° C./second, more preferably at least 10° C./second, most preferably at least 40–60° C/second. Too low a cooling rate below 1° C./second might cause a color change during the fixation. For the same reasons, it is advisable to initiate the color fixation as soon as the color development has been completed.

The thus obtained image on the intermediate layer of the recording medium can be erased by heating at least the image-bearing portion of the intermediate layer above the melting point thereof. The recording medium from which the image has been erased can be used for recording new images. Such image formation and erasure can be repeatedly performed. Further, an image on the recording medium can be over-written with another image by irradiation at a temperature wherein the cholesteric liquid crystal compound assumes a cholesteric liquid crystal phase.

Moreover, the color tone formed by irradiation can be controlled by controlling the light irradiation energy. Therefore, by suitably selecting the kind of the cholesteric liquid crystal compound, the temperature at which the cholesteric liquid crystal compound is maintained and the amount of light irradiated (light intensity and irradiation time), images of various colors may be obtained.

The following examples will further illustrate the present invention.

EXAMPLE 1

In methylene chloride, 100 parts by weight of dicholesteryl eicosadioate and 5 parts by weight of 4,4'-dimethylazobenzene were dissolved. The solution was then dried at room temperature under vacuum. The dried mixture was then placed between a pair of colorless transparent quartz glass plates each having a thickness of 0.18 mm. The whole assembly was heated to 130° C. and then gradually cooled to room temperature to obtain a white recording medium having an intermediate layer of a thickness of about 20 $\mu$m sandwiched between the two glass plates.

The recording medium when placed on a hot stage maintained at 98° C. assumed a green color as a whole. The recording medium was then irradiated with a light from a mercury lamp through a mask for 2 minutes. As a result, the irradiated portion assumes a blue color. The recording medium having a blue image with a green background was immediately immersed in ice water and cooled to 0° C. The color image was found to be fixed.

EXAMPLE 2

In methylene chloride, 97.2 parts by weight of dicholesteryl 10,12-docosadiynedioate and 2.8 parts by weight of 4,4'-dimethylazobenzene were dissolved. The solution was then dried at room temperature under vacuum. The dried mixture was then placed between a pair of colorless transparent quartz glass plates each having a thickness of 0.18 mm. The whole assembly was heated to 130° C. and then gradually cooled to room temperature to obtain a white recording medium having an intermediate layer of a thickness of about 20 $\mu$m sandwiched between the two glass plates.

The recording medium when placed on a hot stage maintained at 105° C. assumed a blue color as a whole. The recording medium was then irradiated with a light from a mercury lamp through a mask for 2 minutes. As a result, the color of the irradiated portion turned violet. The image bearing recording medium was immediately immersed in ice water and cooled to 0° C. The color image was found to be fixed. The reflection spectra of the recording medium revealed that λmax of the image was 418 nm and λmax of the background was 430 nm.

EXAMPLE 3

In methylene chloride, 99 parts by weight of dicholesteryl 10,12-docosadiynedioate and 1 part by weight of 4,4'-di-n-dodecylazobenzene were dissolved. The solution was then dried at room temperature under vacuum. The dried mixture was then placed between a pair of colorless transparent quartz glass plates each having a thickness of 0.18 mm. The whole assembly was heated to 130° C. and then gradually cooled to room temperature to obtain a white recording medium having an intermediate layer of a thickness of about 20 μm sandwiched between the two glass plates.

The recording medium when placed on a hot stage maintained at 87° C. assumed a red color as a whole. The recording medium was then irradiated with a light from a mercury lamp through a mask for 2 minutes. As a result, the irradiated portion assumes a blue color. The recording medium having a blue image with a red background was immediately immersed in ice water and cooled to 0° C. The color image was found to be fixed. The reflection spectra of the recording medium revealed that λmax of the image was 490 nm and λmax of the background was 638 nm.

EXAMPLE 4

The recording medium having a fixed blue image with a red background obtained in Example 3 was heated to 130° C. and then gradually cooled to room temperature to erase the image. The recording medium when then placed on a hot stage maintained at 92° C. assumed a green color as a whole. The recording medium was then irradiated with a light from a mercury lamp through a mask for 2 minutes. As a result, the irradiated portion assumes a blue color. The recording medium having a blue image with a green background was immediately immersed in ice water and cooled to 0° C. The color image was found to be fixed. The reflection spectra of the recording medium revealed that λmax of the image was 470 nm and λmax of the background was 500 nm.

EXAMPLE 5

In methylene chloride, 99 parts by weight of dicholesteryl 10,12-docosadiynedioate and 1 part by weight of 4,4'-di-n-tetradecylazobenzene were dissolved. The solution was then dried at room temperature under vacuum. The dried mixture was then placed between a pair of colorless transparent quartz glass plates each having a thickness of 0.18 mm. The whole assembly was heated to 130° C. and then gradually cooled to room temperature to obtain a white recording medium having an intermediate layer of a thickness of about 20 μm sandwiched between the two glass plates.

The recording medium when placed on a hot stage maintained at 90° C. assumed a red color as a whole. The recording medium was then irradiated with a light from a mercury lamp through a mask for 15 seconds. As a result, the irradiated portion assumes a green color. The recording medium having a green image with a red background was immediately immersed in ice water and cooled to 0° C. The color image was found to be fixed.

The recording medium was again placed on a hot stage maintained at 90° C. so that the recording medium assumed a red color as a whole. The recording medium was then irradiated with a light from a mercury lamp through a mask for 30 seconds. As a result, the irradiated portion assumes a blue color. By rapid cooling with ice water, the image was fixed.

EXAMPLE 6

In methylene chloride, 99 parts by weight of dicholesteryl 10,12-docosadiynedioate and 1 part by weight of 4,4'-di-n-hexadecylazobenzene were dissolved. The solution was then dried at room temperature under vacuum. The dried mixture was then placed between a pair of colorless transparent quartz glass plates each having a thickness of 0.18 mm. The whole assembly was heated to 130° C. and then gradually cooled to room temperature to obtain a white recording medium having an intermediate layer of a thickness of about 20 μm sandwiched between the two glass plates.

The recording medium when placed on a hot stage maintained at 90° C. assumed a green color as a whole. The recording medium was then irradiated with a light from a mercury lamp through a mask for 15 seconds. As a result, the irradiated portion assumes a blue color. The recording medium having a blue image with a green background was immediately immersed in ice water and cooled to 0° C. The color image was found to be fixed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A rewritable, color image recording medium comprising a pair of opposed substrates at least one of which is transparent, and an intermediate layer interposed between said substrates, said intermediate layer comprising at least one cholesteric liquid crystal compound having a molecular weight of not greater than 2,000 and a glass transition point of at least 35° C., and a photochromic compound, said photochromic compound being present in an amount of 0.5–10% by weight based on the weight of said cholesteric liquid crystal compound.

2. A recording medium as set forth in claim 1, wherein said cholesteric liquid crystal compound is represented by the formula:

$$Z—O—CO—R—CO—O—Y$$

wherein Z and Y are each independently selected from the group consisting of a cholesteryl group, a hydrogen atom and an alkyl group with the proviso that at least one of Z and Y stands for a cholesteryl group, and R stands for a divalent hydrocarbyl group having 2–30 carbon atoms.

3. A recording medium as set forth in claim 1, wherein said cholesteric liquid crystal compound is represented by the formula:

$$Z—O—CO—R—CO—O—Y$$

wherein Z and Y are each independently selected from the group consisting of a cholesteryl group, a hydrogen atom and an alkyl group with the proviso that at least one of Z and Y stands for a cholesteryl group, and R stands for a divalent hydrocarbyl group represented by the formula:

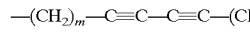

$$—(CH_2)_m—C{\equiv}C—C{\equiv}C—(CH_2)_n—$$

wherein m and n are each independently an integer of 1 or more with the proviso that the total of m and n does not exceed 30.

4. A recording medium as set forth in claim 1, wherein said photochromic compound is an azobenzene compound.

5. A method of recording a color image, comprising the steps of:

(a) providing a rewritable, color image recording medium comprising a pair of opposed substrates at least one of which is transparent, and an intermediate layer interposed between said substrates, said intermediate layer comprising at least one cholesteric liquid crystal compound having a molecular weight of not greater than 2,000 and a glass transition point of at least 35° C., and a photochromic compound capable of changing a color thereof upon irradiation with a light, said photochromic compound being present in an amount of 0.5–10% by weight based on the weight of said cholesteric liquid crystal compound;

(b) while maintaining said intermediate layer at such a temperature that said cholesteric liquid crystal compound assumes a cholesteric liquid crystal phase, irradiating said intermediate layer imagewise with the light through the transparent substrate to form an image;

(c) then rapidly cooling said recording medium obtained in step (b) to a temperature lower than said glass transition point to fix said image.

6. A method as set forth in claim 5, wherein said cooling is at a rate of at least 1° C./second.

7. A method as set forth in claim 5, wherein step (b) is by irradiation with ultraviolet rays.

* * * * *